US005289644A

United States Patent [19]

Driskill et al.

[11] Patent Number: 5,289,644

[45] Date of Patent: Mar. 1, 1994

[54] WATERPROOF FOOTWEAR

[75] Inventors: Kathleen R. Driskill, Townsend; Robert L. Henn, Wilmington; Jean Norvell, Newark, all of Del.

[73] Assignee: W. L. Gore & Associates, Inc., Newark, Del.

[21] Appl. No.: 47,345

[22] Filed: Mar. 29, 1993

Related U.S. Application Data

[63] Continuation of Ser. No. 729,504, Jul. 12, 1991, abandoned.

[51] Int. Cl.[5] ..... A43C 13/08; A43B 23/07

[52] U.S. Cl. ..... 36/14; 36/12; 36/17 R; 36/55

[58] Field of Search ..... 36/7.1 R, 9 R, 10, 7.3, 36/17, 17 PW, 45, 14, 12, 55

[56] References Cited

U.S. PATENT DOCUMENTS

| | | | |
|---|---|---|---|
| 2,437,030 | 3/1948 | Hoza | 36/14 |
| 3,919,035 | 11/1975 | Warrach . | |
| 4,294,022 | 10/1981 | Stockli et al. | 36/4 |
| 4,599,810 | 7/1986 | Sacre | 36/17 R |
| 4,809,447 | 3/1989 | Pacanowsky et al. | 36/9 R |
| 4,819,345 | 4/1989 | Mulcahy et al. . | |
| 4,899,465 | 2/1990 | Bleimhofer et al. | 36/14 |

FOREIGN PATENT DOCUMENTS

| | | | |
|---|---|---|---|
| 0284638 | 10/1988 | European Pat. Off. . | |
| 8914377 | 4/1990 | Fed. Rep. of Germany . | |
| 1133363 | 3/1957 | France | 36/14 |
| 488491 | 12/1953 | Italy | 36/14 |
| 832324 | 4/1960 | United Kingdom | 36/14 |
| 9006067 | 6/1990 | World Int. Prop. O. . | |

*Primary Examiner*—Steven N. Meyers

[57] ABSTRACT

An article of waterproof footwear and its method of manufacture are disclosed. The article of waterproof footwear has an upper containing a water-impermeable layer. The distal edge of the upper has a polymeric binding covering the distal edge and the inside and outside surfaces of the upper adjacent to the distal edge. The polymeric binding seals to a waterproof insole thereby effectively waterproofing the upper of the footwear. An outer sole is attached to the upper thereby forming the waterproof footwear.

The method of manufacture allows production of a waterproof upper and the attachment to the upper of an outer sole, thereby forming the waterproof footwear of the invention.

39 Claims, 4 Drawing Sheets

WATERPROOF FOOTWEAR

This application is a continuation, of application Ser. No. 07/729,504 filed Jul. 12, 1991, now abandoned.

FIELD OF THE INVENTION

This invention relates to waterproof footwear and the method of the manufacture thereof.

BACKGROUND

In order to produce waterproof footwear, footwear is manufactured totally from rubber or another polymer through a dipping or molding technique, such that there is no separation between the upper and the outer sole, and therefore the footwear is water-impermeable. However, waterproof footwear produced through a dipping or molding technique has poor fit, is heavy in weight, and is impermeable to water vapor. Additionally, waterproof footwear produced through a dipping or molding technique is not readily adaptable to various footwear styles.

In recent times, footwear was manufactured whose body or upper part consists of water-impermeable, and preferably, water vapor-permeable material. There have been problems in providing a waterproof connection between the upper and an outer sole of the footwear while still maintaining the good fit, lightweight, and water vapor-permeable quality of the upper material.

In an attempt to produce waterproof footwear whose upper part consists of water-impermeable and water vapor-permeable material, a cement process of lasting footwear was developed. In this process, an upper of a shoe is cemented to an insole. To this unit, a sole is applied which may be an intermediate sole or an outer sole. It is a problem to have truly waterproof footwear with cement-lasted footwear, even if a water-impermeable outer sole and a water-impermeable upper layer are utilized in the construction. The weak point in the production of waterproof cement-lasted footwear is the formation of a durable waterproof seal between the insole and the upper since the lasting cement does not initially seal between the upper and the insole and may become brittle and more water-permeable due to bending stresses during use of the footwear. The formation of a durable waterproof seal between the insole and the upper is hampered in the lasting process since pleats form in the edges of the upper materials because the straight edges of the upper are forced to lay flat against the curved insole. These upper wrinkles are three-dimensional in nature and therefore provide easy routes for water entry into the upper of the footwear.

To overcome problems with the cement process of lasting footwear, a waterproof insert method was developed wherein a unit of a footwear upper and a cemented insole is lined with a sock-like insert of a water impermeable, water vapor-permeable material, as taught in U.S. Pat. No. 4,599,810, to Sacre. To obtain an insert that is waterproof and of the desired shape, the insert must first be sewn and then hot-welded at the sewn seams to form a waterproof article. This waterproof insert method does not allow the insole to be directly attached to a shoe last in a single step as in the traditional cement process of lasting footwear. An additional lasting step is usually required by this method, making this method more complicated and expensive for most shoe manufacturers.

An injection molding process for the soling of footwear, as taught in U.S. Pat. No. 4,899,465 to Bleimhofer, et al., has been used to produce waterproof footwear. A polyurethane outer sole is molded by machine to the sole region of an upper. It is necessary to have an injection mold that is applied to the upper from both sides. This injection mold is relatively expensive. Due to the high mold costs, the shoe manufacturers are restricted to very few sole configurations. Besides, it is not possible to achieve footwear having an elegant appearance with such molded-on outer soles.

The instant invention is directed to an improvement of the cement process of lasting footwear in such a manner that the connection between the upper of the footwear and insole region is waterproof in a reliable manner, while permitting any kind of outer soles to be employed.

SUMMARY OF THE INVENTION

An article of waterproof footwear is provided which includes an upper containing a water-impermeable layer, a proximal opening for receiving a wearer's foot, a proximal edge surrounding the proximal opening, a distal opening, a distal edge surrounding the distal opening. A polymeric binding is adhered to the distal edge of the upper and covers a portion of the inside and outside surfaces of the upper adjacent to the distal edge. A waterproof insole having a top surface for supporting the wearer's foot and a bottom surface sealed to the polymeric binding. An outer sole is subsequently attached to provide a functional article of footwear.

The method for producing the above-described waterproof footwear is also described.

DETAILED DESCRIPTION OF THE INVENTION

The invention provides for an article of waterproof footwear, more particularly, an article of footwear comprising an upper having a water-impermeable layer. The upper has a proximal opening for receiving a wearer's foot, a distal opening having a distal edge covered in a polymeric binding and closed by a waterproof insole sealed in a waterproof manner to the polymeric binding. An outer sole is attached to provide a surface capable of contacting a ground surface to form a functional article of footwear.

The term "footwear" is used throughout to refer to any product intended to be worn on the foot and produced by the footwear industry. As such it should not be read to be particularly limiting and is intended to include footwear such as shoes, boots, soft footwear and slippers.

Figure 1:
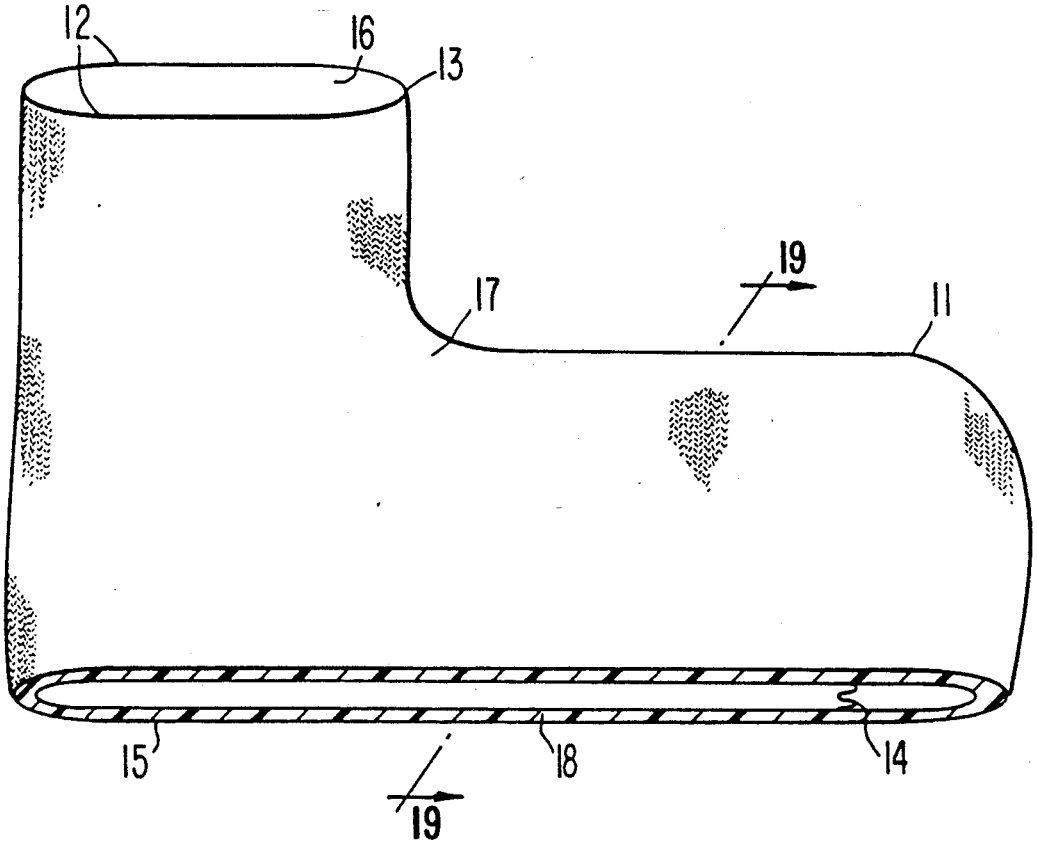
FIG. 1 depicts an upper of the instant invention.

Referring to FIG. 1, an upper 11 is depicted. The upper 11 has a proximal opening 12 which is capable of receiving a wearer's foot. The upper 11 has a proximal edge 13 surrounding the proximal opening 12. The upper 11 has an inside surface 16 and an outside surface 17. The upper 11 has a distal opening 14 having a distal edge 15. Upon the distal 6 ge 15 and in those areas of the inside and outside surfaces of the upper adjacent to the distal edge, a polymeric binding 18 is attached.

Figure 2:
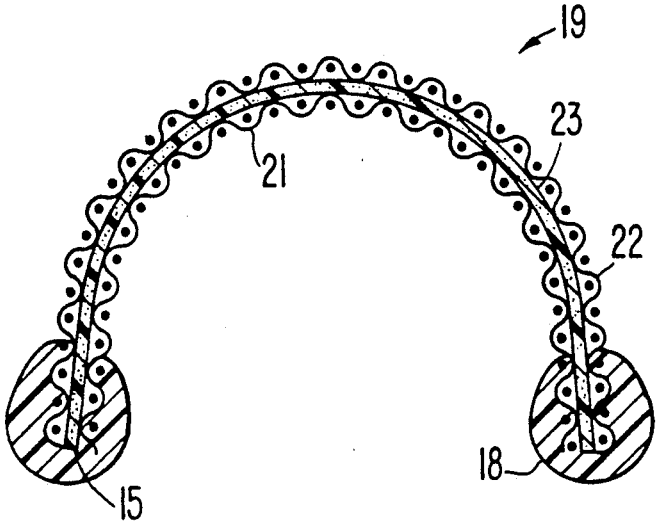
FIG. 2 depicts a cross-section of the upper of FIG. 1.

Referring to FIG. 2, a cross-section of upper 11 of FIG. 1 taken along line 19 is depicted. In FIG. 2, an inside surface material 21 of the upper and an outside surface material 22 of the upper are clearly depicted. The distal edge 15 of the upper as well as inside surface material 21 adjacent to the distal edge 15 and outside surface material 22 adjacent to the distal edge 15 which are covered by the polymeric binding 18 are also clearly depicted.

The upper may be fabricated of various materials including leathers, artificial leathers, or fabrics and laminates thereof. It is preferable that the upper be breathable so as to allow moisture trapped within the article of footwear to escape through the material. A material is defined as breathable if it permits the passage of at least 50 g/($m^2 \times 24$ hr.) of water vapor in the WVTR test described herein.

Still referring to FIG. 2, the upper is comprised of a water-impermeable layer 23. The water-impermeable layer 23 may be laminated to an outside surface material 22 by any number of known laminating means thereby forming a laminated upper. Alternatively, the water-impermeable layer 23 may be attached to the outside surface material 22 only at seams contained in the upper and therefore remain as a distinct layer from the outside surface material. An inside surface material 21 of the upper may also be laminated to the water-impermeable layer 23 by any number of known laminating means, thereby forming a laminated upper. Alternatively, the inside surface material 21 may be attached to the water-impermeable layer 23 only at seams contained in the upper therefore remaining as a distinct layer from the water-impermeable layer.

The water-impermeable layer may be comprised of a layer of a polymeric material. Polymeric materials may be selected from the group consisting of polytetrafluoroethylene (PTFE), polyvinyl chloride, natural rubber, synthetic rubbers, polyester, polyamide, polyurethane, polyethylene and polypropylene. Alternatively, the water-impermeable layer may be a layer selected from the group consisting of waterproof leather, waterproof artificial leather and waterproof fabric.

It is preferable that the water-impermeable layer be a breathable polymeric membrane. Breathable polymeric membranes may be breathable by virtue of pores in the breathable polymeric membrane or through a solution diffusion mechanism. Breathable polymeric membranes may be selected from the group consisting of polyurethane, polyester, polyethers, polyamides, polyacrylates, copolyether esters and copolyether amides. Preferably a water-impermeable breathable polymeric membrane is a membrane of microporous PTFE, more preferably a membrane of expanded microporous PTFE as taught in U.S. Pat. Nos. 3,953,566, and 4,187,390 to Gore and incorporated herein by reference.

The inside surface material of the upper may be leather, artificial leather, or fabric. Preferably, the inside surface material would be of a breathable material as per the previously disclosed definition.

The outside surface material of the upper may be leather, artificial leather, or fabric. Preferably, the outside surface material would be of a breathable material as per the previously disclosed definition.

Still referring to FIG. 2, the polymeric binding 18 is placed on the distal edge 15 and on the inside and outside surface materials, 21 and 22 respectively, of the upper adjacent to the distal edge.

The polymeric binding may be of any material that thoroughly wets and adheres to the distal edge and adjacent surfaces of the upper. The polymeric binding may be polyurethane, natural latex rubber, nitrile rubber, silicone rubber, butyl rubber, fluorinated rubber, copolyether polyester, polyester, ethylene vinyl acetate or polyamide. The polymeric binding may be in the form of a solid material or a foamed material. Preferably, the polymeric binding is a thermoplastic material. Preferably, the polymeric binding is a material having a hardness value less than or equal to 55 D Durometer and greater than or equal to 5 D Durometer, as measured by the test method described herein. More preferable, the polymeric binding is a material having a hardness value less than or equal to 45 D Durometer and greater than or equal to 30 D Durometer.

The polymeric binding may be applied to the distal edge and adjacent surfaces of the upper through various application means. The polymeric binding may be extruded onto the distal edge of the upper. The polymeric material may be dissolved in an appropriate solvent and applied to the distal edge and adjacent surfaces of the upper forming the polymeric binding through brushing, dipping or spraying. The polymeric material may be produced in a tape, sheet or channel form and the tape, sheet or channel form melted onto the distal edge and adjacent surfaces of the upper. A preferred mode of application of the polymeric binding to the upper is to apply the polymeric material through the use of a pair of nipped rollers which are capable of delivering a controlled amount of liquified polymeric material to both the inside and the outside surfaces, as well as the distal edge, of the upper.

Figure 3:
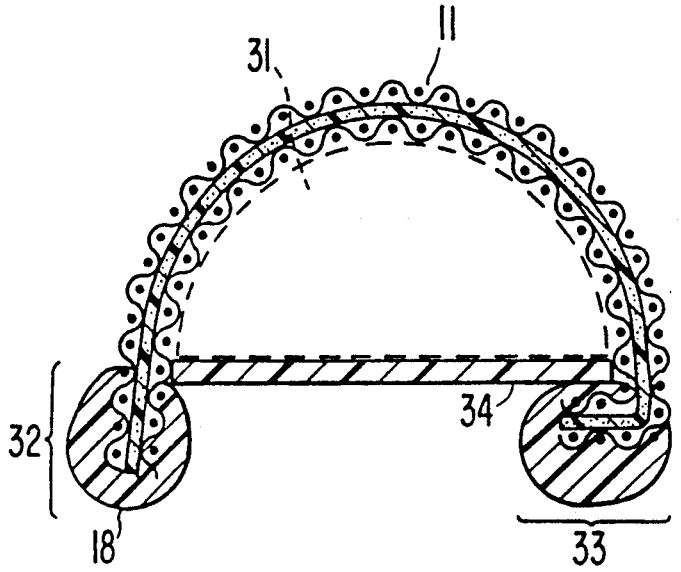
FIG. 3 depicts a cross-section of an upper of the instant invention placed over a shoe last.

Referring now to FIG. 3, the upper 11 with the polymeric binding 18 is positioned on a shoe last 31 depicted in ghost lines. A lasting allowance 32 of the upper can be seen beyond the shoe last 31 and includes the polymeric binding 18. A waterproof insole 34 can be seen resting against the shoe last 31.

The waterproof insole may be waterproof leather, waterproof artificial leather, waterproof leather board, waterproof cellulosic board, waterproof polymeric board, waterproof fabric, or combinations thereof.

Still referring to FIG. 3, a folded lasting allowance 33 can be seen folded over the waterproof insole 34 on the shoe last 31.

The polymeric binding 18 is applied to the upper 11 before the upper is folded over the waterproof insole 34, therefore the polymeric binding is applied to the upper when the upper is planar and free of creases or folds, thereby allowing the polymeric binding to effectively cover the upper where it is applied without the formation of gaps in the polymeric binding in order to present an unbroken polymeric surface for subsequent sealing. This may be done prior to placing the upper on a shoe last or after placing the upper on a shoe last, but in all cases prior to folding the upper over the waterproof insole.

Figure 4:
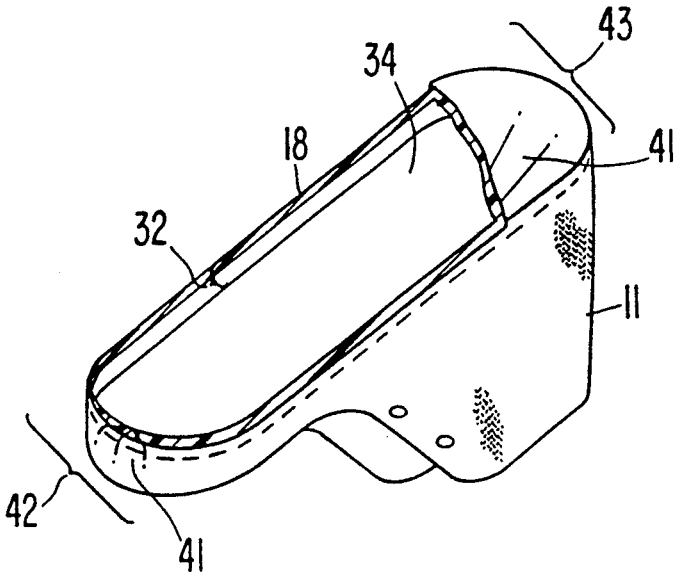
FIG. 4 depicts an upper of the instant invention placed over a shoe last.

Referring to FIG. 4, as the lasting allowance 32 is folded over the waterproof insole 34, pleats 41 in the lasting allowance form particularly in the toe area 42 and heel area 43 of the upper 11. The formation of these pleats is a result of the upper, which is planar in nature, being tautly folded around the rounded periphery of the toe and heel areas of the waterproof insole. The polymeric binding 18 is present on the inside and outside surfaces of the pleats. The polymeric binding having been applied prior to the folding step ensures an adequate amount of polymer material present in all the pleats which are formed when the lasting allowance of the upper is folded over the waterproof insole in the formation of the waterproof footwear.

Returning to FIG. 3, while on the shoe last 31, the folded lasting allowance 33, which includes the polymeric binding 18 of the upper, is attached through a lasting step to the bottom surface of the waterproof insole 34.

In the lasting step, the polymeric binding of the upper is sealed to the waterproof insole through various means. If the polymeric binding or the bottom surface of the waterproof insole is of a material that is thermoplastic in nature and capable of softening and flowing to form a waterproof seal, the application of heat may be used to effectuate a seal between the bottom surface of the waterproof insole and the polymeric binding. Alternatively, an additional amount of a sealant material may be used to effectuate a seal between the polymeric binding and the bottom of the waterproof insole. The sealant material must thoroughly wet and bond both the waterproof insole and the polymeric binding.

Figure 5:
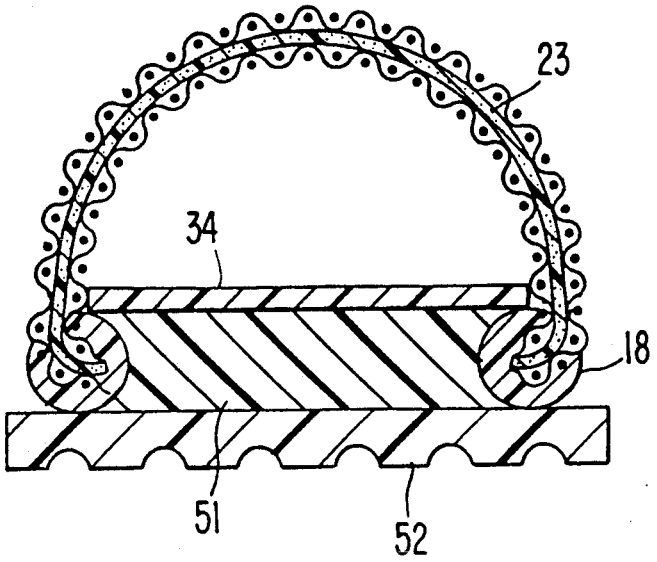
FIG. 5 depicts a cross-section of a shoe of the instant invention.

Referring to FIG. 5, an outer sole 52 is attached to the bottom surface of the waterproof insole 34 and the outer sole is made of a material and is of a design that it is capable of contacting the ground so that a functional article of footwear is formed. The outer sole is preferably attached to the waterproof insole 34 and the polymeric binding 18 of the upper, through the use of an adhesive 51.

The term "outer sole" is used to include midsoles, outer soles, and combinations thereof.

The outer sole may be polyurethane, natural rubber, synthetic rubbers, leather, artificial leather, polyvinyl chloride, ethylene vinyl acetate or combinations thereof.

In the final step, the article of footwear is removed from the shoe last.

Figure 6:
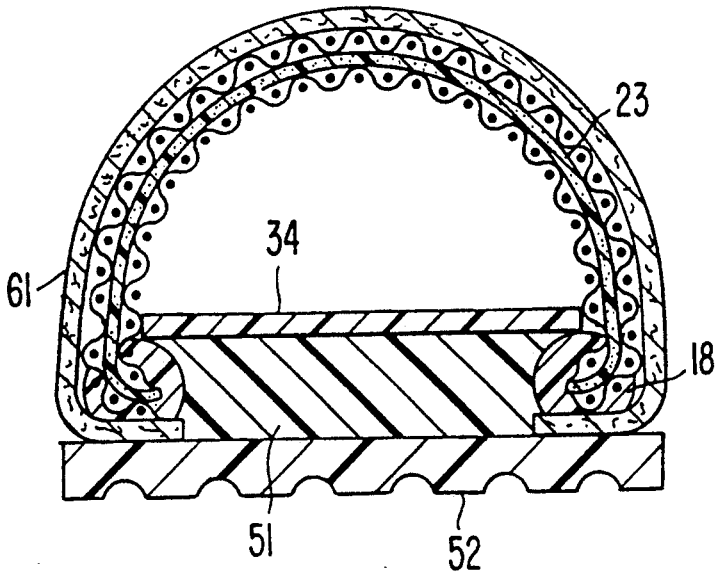
FIG. 6 depicts a cross-section of a shoe of the instant invention having an upper shell adhered to an outer sole.

Alternatively, referring to FIG. 6, the outer sole 52 may be attached to an upper shell 61 through an adhesive process. The upper shell may be leather, artificial leather or fabric.

Figure 7:
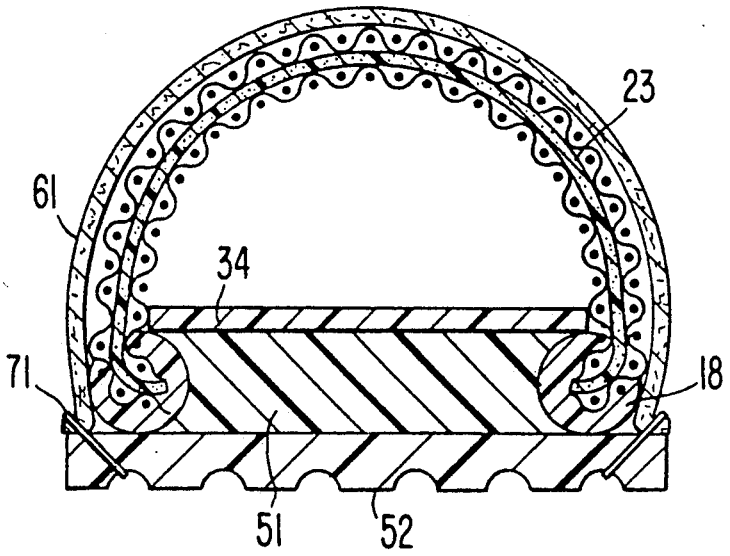
FIG. 7 depicts a cross-section of a shoe of the instant invention having an upper shell stitched to an outer sole.

Referring to FIG. 7, an alternate embodiment of the waterproof footwear of this invention is depicted wherein the upper shell 61 is attached to the outer sole 52 by means of a physical attachment. In FIG. 7, the means of physical attachment depicted is a stitch 71. Alternatively, the means of physical attachment may be a staple or a nail.

TEST DESCRIPTIONS

WATER VAPOR TRANSMISSION RATE (WVTR)

A description of the test employed to measure water vapor transmission rate (WVTR) is given below. The procedure has been found to be suitable for testing the materials and products of this invention.

In the procedure, approximately 70 ml. of a solution consisting of 35 parts by weight of sodium chloride and 15 parts by weight of distilled water was placed into a 133 ml. polypropylene cup, having an inside diameter of 6.5 cm. at its mouth.

An expanded polytetrafluoroethylene (PTFE) membrane having a WVTR of approximately 34,200 g/(m$^2$×24 hr.) as tested by the method described in U.S. Pat. No. 4,862,730 to Crosby, and available from W. L. Gore & Associates, Inc. of Newark, Del., was heat sealed to the lip of the cup to create a taut, leakproof, microporous barrier containing the solution. A similar expanded PTFE membrane was mounted to the surface of a water bath. The water bath assembly was controlled at 23° C. plus or minus 0.2° C., utilizing a temperature controlled room and a water-circulating bath.

The sample to be tested was allowed to condition at a temperature of 23° C. and a relative humidity of 50% prior to performing the test procedure. Samples were placed in contact with the expanded polytetrafluoroethylene membrane mounted to the surface of the water bath.

The cup assembly was weighed to the nearest 1/1000 g and was placed in an inverted manner onto the center of the test sample.

The sample was tested for 30 minutes and the cup assembly was removed and reweighed within 1/1000 g.

The WVTR of the sample was calculated from the weight gain of the cup assembly and was expressed in grams of water per square meter of sample surface area per 24 hours.

HARDNESS TEST FOR POLYMERS

The ASTM Standard Test Method D2240-86 for Rubber Property-Durometer Hardness is used to measure polymer softness. The method is based on the penetration of a steel indentor forced into a material for a specified time. A Type D scale durometer was used.

A larger D reading indicates a harder material.

EXAMPLE

A women's style boot was made with upper materials consisting of an upper shell of approximately 170 g/m$^2$ nylon taffeta fabric, and an upper consisting of a water-impermeable and air-impermeable layer of expanded microporous PTFE membrane, (GORE-TEX® membrane available from W. L. Gore & Associates, Inc., Newark, Del.), manufactured according to the teachings of the U.S. Pat. Nos. 3,953,566 to Gore, and 4,194,041 to Gore, et al., incorporated herein by reference. The water-impermeable layer was laminated on one face to a nylon tricot knit weighing approximately 50 g/m$^2$ and on the other face to the foamed side of a polyester/nylon tricot knit weighing approximately 130 g/m$^2$ backed with a polyurethane foam approximately 0.12 cm thick. The upper was water vapor-permeable, having a WVTR of approximately 1000 g/(m$^2$×24 hr.), as tested by the WVTR method described above. The insole was cellulosic, (available from Georgia Bonded Fibers, Inc., Buena Vista, VA). The outer sole was a composite polymer.

A polyurethane adhesive in solvent form was made by synthesizing a polyurethane polymer in dichloromethane solvent at 25% solids level. The approximate molar equivalent ratio was (1.0:0.805:0.2) dicyclohexylmethane-4,4'diisocyanate: 2,2'-oxybis(ethanol)-:poly(oxyethylene) glycol (avg. M.W. 1420). Dibutyltin dilaurate was used as a catalyst (approximately 0.65 wt. % of diisocyanate). When synthesis had proceeded so that the free isocyanate content had fallen to 0.13% by a standard dibutylamine titration procedure, dibutylamine (approximately 0.60 wt. % of diisocyanate) was added.

A 76 um thick film of the polyurethane adhesive had a measured WVTR of 4500 g/($m^2 \times 24$ hr.).

The bottom surface of the cellulosic insole was coated twice with the polyurethane adhesive in solvent form and allowed to dry tack-free between each coating step. This procedure effectively waterproofed the bottom surface of the insole. The waterproof insole was attached with two nails to a shoe last with the side containing the polyurethane adhesive away from the shoe last surface.

The upper shell and upper were cut and stitched separately. Stitched seams in the upper were sealed through the use of a thermoplastic adhesive tape (GORE-SEAM TM tape, available from W. L. Gore & Associates, Inc., Newark, Del.) in order to ensure waterproofness of the upper.

The upper shell and the upper were then stitched together at the proximal opening of the upper forming a collar but not at the distal opening in the area of the lasting allowance of the upper.

The polyurethane adhesive in film form was employed as the polymeric binding for the upper. To obtain a film, the polyurethane adhesive in solvent form was cast onto release paper using a coating knife and the solvent was evaporated. The resulting polyurethane film was approximately 100 um thick. Durometer hardness of the polyurethane film was approximately 35 D. The polyurethane film was thermoplastic and could be melted by applying approximately 90° C. heat.

Heat from a hand held iron was employed to melt and transfer the polyurethane film from release paper to the distal edge of the upper. At the high dry heat setting of the iron, the polyurethane film transferred easily after about 10 seconds onto the surfaces of the upper. Approximately 2 cm of the inside surface of the distal edge of the upper was continuously coated with the polyurethane film, and approximately 1 cm polyurethane film was left extending over the distal edge of the upper.

The upper was then turned over and heat was again employed to transfer the polyurethane film onto the outside surface of the distal edge of the upper. Approximately 2 cm of the outside surface of the distal edge of the upper was continuously coated with the polyurethane film, and approximately 1 cm polyurethane film was left extending over the distal edge of the upper. In this step, the extending polyurethane film from the inside surface was melt-bonded to the extending polyurethane film from the outside surface at the distal edge of the upper, thus binding or sealing the distal edge of the upper. The polymeric binding was now present on the distal edge and on the adjacent inside and outside surfaces of the upper.

A second layer of polyurethane film was placed over the first layer using the same techniques as previously described to obtain a polymeric binding with an adequate thickness.

The upper shell and the upper were tacked to each other with an adhesive at the distal edge of the upper. Stitching through of the polymeric binding of the upper was avoided so that the waterproof quality of the polymeric binding on the distal edge of the upper would not be compromised.

The distal opening of the upper was placed on the shoe last to which was nailed the waterproof insole. The lasting allowance, or the length of upper materials extending beyond the shoe last, was carefully folded over the bottom surface of the waterproof insole. In doing so, many pleats appeared in the folded distal edges of the upper shell and the upper, which had the polymeric binding. This pleating was particularly apparent in the toe and heel areas.

To permanently attach and seal the upper to the waterproof insole, an ethylene vinyl acetate (EVA) hot melt cement was employed, (available from Bostik, Boston St., Middleton, Mass.) in 1 cm diameter thermoplastic rods. The hot melt cement was generously applied with a hot melt gun between the waterproof insole and the polymeric binding of the folded upper. The polymeric binding of the folded upper was then held with hand pressure against the waterproof insole for approximately 30 seconds in order for the hot melt cement to set and hold fast the upper to the waterproof insole. Next, the two nails which had been driven through the waterproof insole into the shoe last were removed. The holes left by the nails were filled with the hot melt cement to waterproof the waterproof insole again.

The polyurethane adhesive in solvent form was employed as a soling cement. The waterproof insole, the lasting allowance of the upper and the inside face of the composite outer sole were coated with the polyurethane adhesive in the solvent form. The solvent was evaporated and heat from a heat gun was directed to all coated surfaces until the adhesive melted. Then the outer sole was placed into contact with the waterproof insole and the lasting allowance of the upper and pressure from a shoe press was applied for about approximately 5 seconds. The shoe last was removed from the boot.

The boot was tested by the waterproofness method taught in U.S. Pat. No. 4,799,384 to Casali, incorporated herein by reference. The proximal opening of the upper of the boot was clamped in air tight jaws. Air was fed into the boot from the proximal opening and pressurized to approximately 7 kPa. The air-filled boot was then submerged in a water tank to approximately 5 cm from the clamped jaws. The boot was observed on all sides for one minute for the presence of a continuous stream of air bubbles which indicates a leak. No leak was observed in the boot produced in Example 1, thereby indicating a waterproof boot.

We claim:

1. An article of waterproof footwear which comprises:

(a) an upper comprised of a water-permeable layer and having a proximal opening for receiving a wearer's foot, a proximal edge surrounding the proximal opening, a distal opening, a distal edge surrounding the distal opening, and inside and outside surfaces;

(b) a polymeric binding adhered to and encapsulating the distal edge of the upper and covering a portion of the inside and outside surfaces of the upper adjacent to the distal edge, wherein an inner surface of the polymeric binding is formed;

(c) a separate waterproof insole having a top surface for supporting the wearer's foot and a bottom surface adhesively bonded without stitching to the inner surface of the polymeric binding; and (d) an outer sole attached to the bottom surface of the waterproof insole and polymeric binding of the upper.

2. An article of waterproof footwear as defined in claim 1 wherein the polymeric binding is in the form of a solid material.

3. An article of waterproof footwear as defined in claim 1 wherein the polymeric binding is in the form of a foamed material.

4. An article of waterproof footwear as defined in claim I wherein the polymeric binding is polyurethane.

5. An article of waterproof footwear as defined in claim 1 wherein the polymeric binding is natural latex rubber.

6. An article of waterproof footwear as defined in claim 1 wherein the polymeric binding is nitrile rubber.

7. An article of waterproof footwear as defined in claim 1 wherein the polymeric binding is silicone rubber.

8. An article of waterproof footwear as defined in claim 1 wherein the polymeric binding is butyl rubber.

9. An article of waterproof footwear as defined in claim 1 wherein the polymeric binding is fluorinated rubber.

10. An article of waterproof footwear as defined in claim 1 wherein the polymeric binding is polyester.

11. An article of waterproof footwear as defined in claim 1 wherein the polymeric binding is copolyether polyester.

12. An article of waterproof footwear as defined in claim 1 wherein the polymeric binding is ethylene vinyl acetate.

13. An article of waterproof footwear as defined in claim 1 wherein the polymeric binding is polyamide.

14. An article of waterproof footwear as defined in claim 1 wherein the polymeric binding is a material having a hardness value less than or equal to 55 D Durometer and greater than or equal to 5 D Durometer.

15. An article of waterproof footwear as defined in claim 1 wherein the polymeric binding is a material having a hardness value less than or equal to 45 D Durometer and greater than or equal to 30 D Durometer.

16. An article of waterproof footwear as defined in claim 1 wherein the water impermeable layer is comprised of a layer of a polymeric material.

17. An article of waterproof footwear as defined in claim 16 wherein the polymeric material is selected from a group consisting of polytetrafluoroethylene, polyvinyl chloride, natural rubber, synthetic rubbers, polyester, polyamide, polyurethane, polyethylene and polypropylene.

18. An article of waterproof footwear as defined in claim 1 wherein the water-impermeable layer is selected from a group consisting of waterproof leather, waterproof artificial leathers and waterproof fabrics.

19. An article of waterproof footwear as defined in claim 1 wherein the water-impermeable layer is a breathable polymeric membrane.

20. An article of waterproof footwear as defined in claim 19 wherein the breathable polymeric membrane is selected from a group consisting of polyurethane, polyester, polyethers, polyamides, polyacrylates, copolyether esters and copolyether amides.

21. An article of waterproof footwear as defined in claim 19 wherein the breathable polymeric membrane is microporous polytetrafluoroethylene.

22. An article of waterproof footwear as defined in claim 21 wherein the microporous polytetrafluoroethylene is expanded microporous polytetrafluoroethylene.

23. An article of waterproof footwear as defined in claim 1 further comprising an upper shell attached to the outer sole.

24. An article of waterproof footwear as defined in claim 23 wherein the upper shell is leather.

25. An article of waterproof footwear as defined in claim 23 wherein the upper shell is fabric.

26. An article of waterproof footwear as defined in claim 23 wherein the upper shell is artificial leather.

27. An article of waterproof footwear as defined in claim 1 wherein the upper further comprises an outside surface material.

28. An article of waterproof footwear as defined in claim 27 wherein the outside surface material is leather.

29. An article of waterproof footwear as defined in claim 27 wherein the outside surface material is artificial leather.

30. An article of waterproof footwear as defined in claim 27 wherein the outside surface material is fabric.

31. An article of waterproof footwear as defined in claim 27 wherein the outside surface material is laminated to the water-impermeable layer.

32. An article of waterproof footwear as defined in claim 27 wherein the outside surface material is attached to the water-impermeable layer at seams contained in the upper.

33. An article of waterproof footwear as defined in claim 1 wherein the upper further comprises an inside surface material.

34. An article of waterproof footwear as defined in claim 33 wherein the inside surface material is leather.

35. An article of waterproof footwear as defined in claim 33 wherein the inside surface material is artificial leather.

36. An article of waterproof footwear as defined in claim 33 wherein the inside surface material is fabric.

37. An article of waterproof footwear as defined in claim 33 wherein the inside surface material is laminated to the water-impermeable layer.

38. An article of waterproof footwear as defined in claim 33 wherein the inside surface material is attached to the water-impermeable layer at seams contained in the upper.

39. A method for producing an article of waterproof footwear which comprises the steps of:

(a) forming an upper having a proximal opening for receiving a wearer's foot, a proximal edge surrounding the proximal opening, a distal opening, a distal edge surrounding the distal opening, and inside and outside surfaces;

(b) adhering a polymeric binding to encapsulate the distal edge of the upper and covering a portion to the inside and outside surfaces of the upper adjacent to the distal edge, forming an inner surface of the polymeric binding;

(c) adhesively bonding without stitching a waterproof insole at its bottom surface to the inner surface of the polymeric binding; and (d) attaching an outer sole to the waterproof insole board and polymeric binding of the upper.

* * * * *